United States Patent [19]

Rochla

[11] 4,106,395

[45] Aug. 15, 1978

[54] METHOD AND APPARATUS FOR PRODUCING STACKS OF FOLDED BAGS

[75] Inventor: Kurt Rochla, Lengerich, Fed. Rep. of Germany

[73] Assignee: Windmoller & Holscher, Lengerich, Fed. Rep. of Germany

[21] Appl. No.: 742,608

[22] Filed: Nov. 17, 1976

[30] Foreign Application Priority Data

Nov. 17, 1975 [DE] Fed. Rep. of Germany ..... 2551569

[51] Int. Cl.[2] ..... B31B 23/26

[52] U.S. Cl. ..... 93/35 R; 93/32; 93/84 TW; 93/93 HT

[58] Field of Search ..... 93/35 R, 8 R, 14–20, 93/32, 93 HT, 93 R, 84 TW, 84 R; 225/100

[56] References Cited

U.S. PATENT DOCUMENTS

| | | | |
|---|---|---|---|
| 3,374,714 | 3/1968 | Berghgracht | 93/8 R |
| 3,507,194 | 4/1970 | Schwarzkopf | 93/8 R |
| 3,552,278 | 1/1971 | Guenther | 93/8 R |
| 3,656,415 | 4/1972 | Hook, Jr. | 93/20 |
| 4,036,116 | 7/1977 | Tetenborg et al. | 93/32 |

*Primary Examiner*—James F. Coan

*Attorney, Agent, or Firm*—Fleit & Jacobson

[57] ABSTRACT

A web of bag-making material consists of a flattened tube or a single sheet that is longitudinally folded to double thickness. The bags are formed by providing the web with transverse weld seams at intervals and, adjacent to these seams, with lines of perforations extending parallel thereto. The web is then folded and, after folding, the individual bags are severed along the lines of perforations.

6 Claims, 10 Drawing Figures

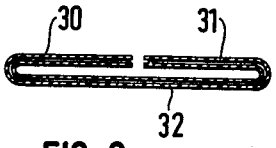
FIG. 3
FIG. 7
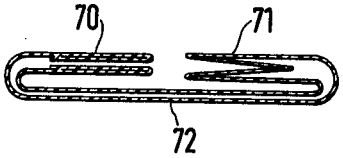
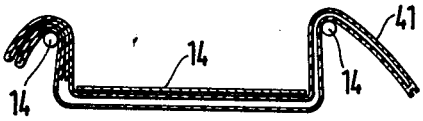
FIG. 4
FIG. 8
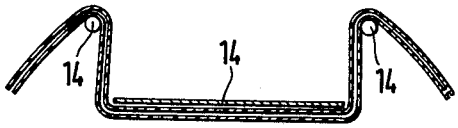
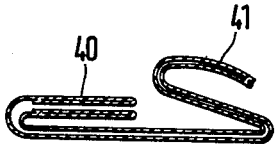
FIG. 5
FIG. 9
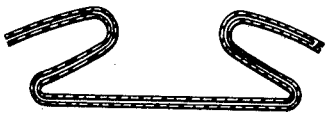
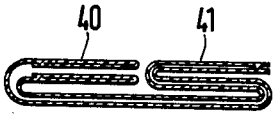
FIG. 6
FIG. 10
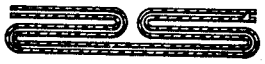

METHOD AND APPARATUS FOR PRODUCING STACKS OF FOLDED BAGS

The invention relates to a method of producing stacks of folded bags from a tubular or semi-tubular web which, to form the bags, is provided with transverse weld seams and from which the subsequently stacked bags are severed, and to an apparatus for carrying out this method.

In a method of this kind known from DT-OS No. 2,356,126, the flattened bags severed from a web are pushed in a transverse position beneath an elongated sizing plate which forms folding edges for the transverse folding and which covers its central portion, the base and handle portions of the bags being successively turned over about the folding edges. For the purpose of folding over, folding plates are provided which are bent out of the inlet plane towards the sizing plate in a helical formation, the individual bags being transported by means of a suction belt through the folding station that consists of the sizing plate as well as the lateral folding plates. To carry out the known method, which has proved successful in practice, suction belts are required adjacent to the folding means for the purpose of advancing the individual bags and thus the folding apparatus is not only comparatively long but also expensive. Further, disruptions may occur through incorrect folding as the individual bags pass through the folding station.

In German Patent Application No. P 25 04 801.5, the Applicants have already suggested a method of stacking flattened, one-sidedly open bags that are folded about at least two transverse folds and have handle apertures in a reinforced margin at the mouth formed by a plurality of layers, wherein the margin at the mouth is folded about a folding edge beneath the reinforcing layers and the end of the bag at the base is folded in Z formation or, if there is a base fold, is folded inwardly towards the central portion of the bag in such a way that the inwardly folded portions lie on the bag next to one another. The bags folded in this manner can be superposed to form edge-aligned stacks without the need for lateral guides or supports because they have the same number of layers of bag side walls over practically their full breadth.

It is the aim of the present invention to provide a method permitting simple, automatic, continuous and faultless folding and stacking of bags.

According to the invention, this aim is fulfilled in a method of the aforementioned kind in that the web is provided adjacent to the bag-forming weld seams with lines of perforations that extend parallel thereto and is folded, and that the folded bags are torn off the chain of bags so formed. By reason of the fact that the bags are still interconnected as a chain of bags during folding, this chain can be readily pulled through the folding station, for example by conveyor rollers, so that one can dispense with complicated conveying means which transport the separated bags through the folding station. According to the method of the invention, one cannot only increase the speed of production but also reduce the number of break-downs. Desired and advantageous folding of the bags to be stacked can be achieved by corresponding folds in the chain of bags.

An apparatus for carrying out the method of the invention is characterised in that means for fabricating the chain of bags are followed by a folding station for longitudinally folding the bag chain discharged from said means and the folding station is followed by a severing station for tearing the bags from the bag chain as well as by stacking means. The apparatus according to the invention is shorter than the previously described known apparatus and is lower in purchase price and running costs because the suction belts are omitted and there is no need to make suction air available.

An example of the invention will now be described in more detail with reference to the drawing, in which:

FIGS. 3 to 10 are diagrammatic sectional views taken on the line III—III in FIG. 1 showing different transverse folding of the bags.

Figure 1:
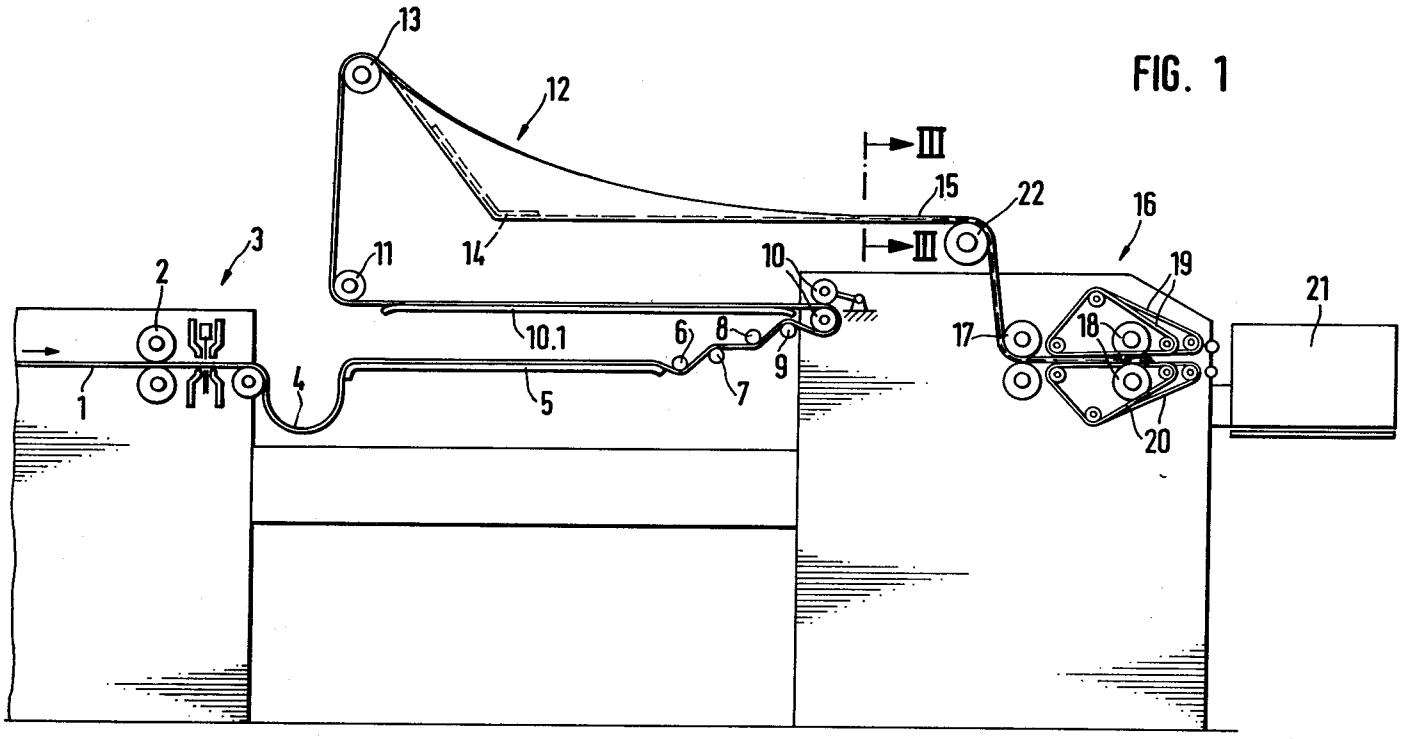
FIG. 1 is a diagrammatic side elevation of the apparatus for producing stacks of bags from tubular or semi-tubular webs.

A flattened web, a tubular or semi-tubular web of thermoplastic film, is transformed to a semi-tubular web 1 in process steps (not shown) performed on equipment (not shown) by appropriate folding and/or welding. Individual bags can be formed on the web 1 by transverse welds. The web 1 thus prepared is fed by a pair of tensioning rollers 2 to a welding and perforating station 3 which provides the web with two parallel weld seams extending transversely to the feeding direction of the web and simultaneously perforates the web between the weld seams. The chain 4 of bags thus formed is formed over a cooling plate 5, on which the transverse welds are cooled in known manner, over stationary bars 6 to 9 and a pair of tensioning rollers 10 as well as over a direction changing roller 11 to a folding station 12 for forming longitudinal folds, the folding station consisting of a guide roller 13 and folding formers 14. The folding former 14 consists of a flanged plate by means of which the side portions of the web are folded onto its central portion in known manner.

Between the welding and perforating station 3 and the cooling plate 5, the chain 4 of bags forms a freely suspended loop so as to balance out the intermittent forward motion occasioned by the welding and perforating station 3 as compared with the continuous feed produced by the pair of tensioning rollers 10. Between the pair of tensioning rollers 10 and the direction-changing roller 11 there is a guide plate 10.1 on which the chain 4 of bags slides. In the longitudinal fold-forming station 12, the handle portions and the base portions of the interconnected bags of the chain 4 are folded onto the central portion in such a way that the number of layers of the central portion covered by the handle portion as well as of the handle portion itself is equal to or substantial equal to the number of layers of the central portion covered by the base portion, including the base portion. The bag chain of which the width has thereby been reduced to the width of the central portion of the bags is designated 15. By way of a direction-changing roller 22, it is fed to a severing station 16 consisting of pairs of tensioning rollers 17, 18 and belt guides 19, 20, the runs of the belts of the belt guides 19, 20 supporting the bag chain 15 or the severed bags loosely running in grooves of the rollers of the pair of tensioning rollers 18. The pair of tensioning rollers 18 has a somewhat higher rotary speed than the pair of tensioning rollers 17 which moves with the speed of the web of the chain 15 of bags and the speed of which can be regulated in known manner by means of control gearing. By means of the tensile force exerted on the bag chain between the tensioning rollers 17 and 18, the individual folded bags are severed from the bag chain 15 along the transverse perforations. They reach a depositing or stack-forming station 21, whence they are conveyed further to packaging stations (not shown) and there packed in known manner to form packets of stacks. FIGS. 3 to 10 show the different possibilities of transversely folding bags. The transverse folds make the bags stronger and allows them to be transferred more readily to the depositing compartment without buckling, so that trouble-free depositing and stacking is possible. The formation of stacks to medium and large heights is improved further by the fact that over the width of the stack there will be the same or substantially the same number of layers whereby the folded product will have a uniform thickness, so that it is ensured that the stacks will always be edge-aligned even when many bags are superposed on one another.

FIG. 3 is a diagrammatic section through a bag without handle reinforcement and without a base fold. The handle portion 30 and base portion 31 are folded onto the central portion 32. The folded bag comprises a number of layers of four layers.

FIGS. 4 to 6 show how a bag reinforced at the handle margin is folded. In order to balance out the double number of layers in the handle zone 40 of each bag wall, the base portion 41 is folded onto itself. This is effected by appropriate formation of the fold former 14. In order to balance out across the width the number of layers of a bag with base fold and handle portion reinforcement, the base portion 71 and handle portion 70 are simply folded onto the central portion 72 as is shown in FIG. 7.

FIGS. 8 to 10 show that a simple bag without handle reinforcement and without base fold can, by appropriately constructing the base former 14, be transversely folded twice so as to achieve the greatest possible stiffness of the folded bag against buckling and bending. This also reduces the width of the package of a stack of bags folded in this manner, which may bring advantages under certain circumstances.

Starting with a tube of film, for the purpose of forming bags this may also be provided with a transversely extending weld seam and, directly adjacent thereto, with a parallel line of perforations. After folding the chain of bags inwardly and tearing off the bags, the latter are folded about longitudinal fold lines.

Figure 2:
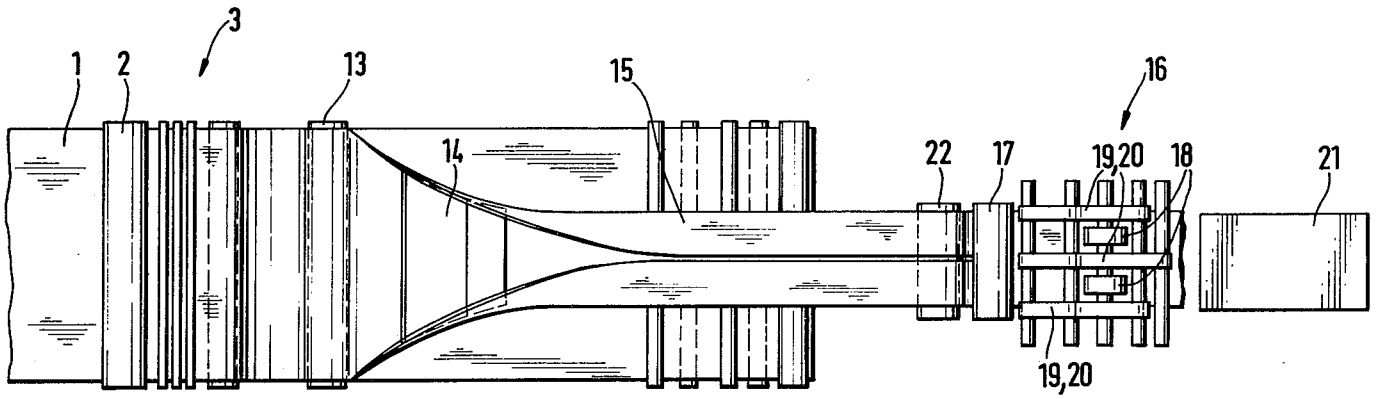
FIG. 2 is a plan view of the FIG. 1 apparatus.

The apparatus shown in FIGS. 1 and 2 can also be in the form of a twin or tandem machine in that two webs 1 or 15 are juxtaposed and each provided with a fold former 14 and a severing station 16. This can double the output of the machine, it being possible simultaneously to produce different sizes or bag shapes.

I claim:

1. A method of producing stacks of folded bags from a chain of formed bags, the bags being formed from a tubular or semi-tubular web having transverse bag-forming weld seams and lines of perforations parallel and adjacent to the transverse weld seams, said method comprising:

folding the chain of formed bags thereby forming connected, individually folded bags;

severing individual folded bags, along the lines of perforations, from the folded chain of formed bags; and stacking the individual folded bags.

2. A method according to claim 1 characterized in that side strips of the chain of formed bags are folded onto a central portion of the chain during the folding of the chain.

3. A method according to claim 1 characterized in that the bags are formed from a semi-tubular web and in that two transverse weld seams form the side seams of the bag, the lines of perforations being provided between two weld seams forming side seams of adjacent bags.

4. A method according to claim 1 characterized in that side strips of the chain of formed bags are folded onto a central portion of the chain in a generally Z-shape during the folding of the chain.

5. A method according to claim 1 characterized in that the individual bags are severed from the chain of formed bags by tearing.

6. An apparatus for producing stacks of folded bags from a chain of formed bags, the bags being formed from a perforated, tubular or semi-tubular web having transverse bag-forming weld seams, the apparatus comprising:

means for longitudinally folding the edges of the chain of formed bags inwardly onto a central portion of the chain thereby forming connected, individually folded bags;

means for severing individual folded bags from the folded chain of formed bags by tearing the folded chain along the lines of perforations; and means for stacking the individual folded bags.

* * * * *